US005520458A

United States Patent [19]

Arutyunov et al.

[11] Patent Number: 5,520,458

[45] Date of Patent: May 28, 1996

[54] VERTICAL SHIFT MIXING ASSEMBLY

[76] Inventors: Yury A. Arutyunov, Apt. 76, 1, Ametkhan Sultan Street; Sergei V. Kotov, Apt. 86, 4a, Michurin Street, both of Zhukovsky, 140160, Russian Federation

[21] Appl. No.: 402,168

[22] Filed: Mar. 13, 1995

Related U.S. Application Data

[63] Continuation-in-part of Ser. No. 98,910, Jul. 29, 1993, abandoned.

[30] Foreign Application Priority Data

Jul. 29, 1992 [RU] Russian Federation ..... 5057067
Aug. 7, 1992 [RU] Russian Federation ..... 5058228

[51] Int. Cl.[6] ..... B01F 7/32; B01F 5/12

[52] U.S. Cl. ..... 366/297; 366/262; 366/325.94; 366/343; 416/122; 416/227 R

[58] Field of Search ..... 366/66, 97, 129, 366/262, 263, 265, 297, 299–301, 325.1, 325.6, 325.94, 329.1, 330.1, 342, 343, 605; 416/122, 227 R, 227 A, 231 A

[56] References Cited

U.S. PATENT DOCUMENTS

| | | | |
|---|---|---|---|
| 216,053 | 6/1879 | Mooney | 366/342 X |
| 375,384 | 12/1887 | Quack . | |
| 793,142 | 6/1905 | Merrell | 416/122 |
| 868,220 | 10/1907 | Portelli et al. | 416/227 A X |
| 1,733,516 | 10/1929 | Rodin et al. | 366/300 |
| 2,053,401 | 9/1936 | La Valley | 416/122 |
| 2,515,713 | 7/1950 | Johnson et al. | 416/227 X |
| 2,539,017 | 1/1951 | Hansen | 416/122 X |
| 2,559,418 | 7/1951 | Ford . | |
| 2,628,082 | 2/1953 | Fredenhagen et al. . | |
| 3,314,660 | 4/1967 | Arbiter | 416/122 X |
| 3,717,330 | 2/1973 | Pinney . | |
| 4,615,623 | 10/1986 | Wethern . | |
| 4,776,703 | 10/1988 | Oda et al. . | |
| 4,871,259 | 10/1989 | Harada et al. . | |
| 5,094,543 | 3/1992 | Mursa . | |

FOREIGN PATENT DOCUMENTS

| | | | |
|---|---|---|---|
| 62-19216 | 4/1987 | Japan . | |
| 64-75029 | 3/1989 | Japan . | |
| 1473828 | 4/1989 | U.S.S.R. | 366/343 |

OTHER PUBLICATIONS

Photographs of Black & Decker mixing blade

*Primary Examiner*—Charles E. Cooley
*Attorney, Agent, or Firm*—Dickstein Shapiro & Morin

[57] ABSTRACT

A mixing blade assembly having two vertical shafts oriented parallel to one another, each shaft carrying two blades, wherein an upper (horizontal) element of each blade is rectilinear and shorter in length than a bottom "S" shaped curved element of each blade, the upper and bottom elements of each blade of one shaft are connected by curved side elements that are the inverse of the curved side elements connecting the upper and bottom elements of the blades of the second shaft.

16 Claims, 12 Drawing Sheets

VERTICAL SHIFT MIXING ASSEMBLY

This is a continuation-in-part of application Ser. No. 08/098,910, filed Jul. 29, 1993, now abandoned. All subject matter disclosed in the 08/098,910 application is incorporated herein by reference.

BACKGROUND OF THE INVENTION

The present invention relates to devices that mix two or more ingredients, for instance; liquids, granules, and their combinations, when preparing dough, cremes, and concrete.

There is an attachment known that includes two upright shafts set at some distance from each other and carrying one blade each, a blade on one shaft having its bottom element pretwisted clockwise, with respect to the top element, by 90 degrees about the shaft axis, and the blade on the other shaft, by 90 degrees counter-clockwise. With this, the side elements of the blades are helical lines, both top and bottom elements are straight line segments of equal lengths. Said shafts rotate synchronously, in mutually opposite directions (see Japanese patent #1(64)-75029, BOIF 15/02, published Mar. 20, 1989).

This design cannot reach high mixing efficiency. At high rotation speeds of 5000 to 8000 RPM (typical of state-of the-art mixers) its performance turns out to be poor.

The other prototype (Japanese patent # 62-19216, BOIF 7/18, published Apr. 27, 1987 # 2-481) includes two vertical shafts installed at a certain distance from one another, each carrying two thin-wire blades mounted normal to each other. Leading edges of side elements of the blades are sharpened. Said shafts with said blades are rotated synchronously, one clockwise and the other counter-clockwise.

This attachment does not attain high efficiency of mixing, and instead requires much energy and time in operation.

SUMMARY OF THE INVENTION

The mixing blade assemblies described herein are capable of improving the process.

This objective, in all embodiments expounded, is achieved by setting two vertical parallel shafts (at a certain distance between them) each carrying two blades oriented perpendicularly to one another. The upper (horizontal) element of each blade is rectilinear and shorter-length as compared to the bottom element.

In addition, the first preferred embodiment features the fact that each side element of the blades mounted on one shaft forms a curve that is generally concave in one direction along a first portion of the side element and generally concave in an opposite direction along a second portion of the side element, and each of their bottom elements forms an "S" shaped curve. Each side element of the blades mounted on the other shaft forms a curve that is also generally concave in one direction along a first portion of the side element and generally concave in an opposite direction along a second portion of the side element, and each of their bottom elements forms an inverted "S" shaped curve. The curve formed by the side element of the blades mounted to the first shaft is the inverse of the curve formed by the side element of the blades mounted to the second shaft.

In the second preferred embodiment each side component of the blades on one shaft forms a curve that is generally concave away from the shaft, and each of their bottom elements form an "S" shaped curve. Each side element of the blades on the other shaft forms a curve that is also generally concave away from the shaft, and each of their bottom elements form an inverted "S" shaped curve. The curve formed by the side element of the blades mounted to the first shaft is the inverse of the curve formed by the side element of the blades mounted to the second shaft.

In the third preferred embodiment each side component of the blades on one shaft forms a curve that is generally concave toward the shaft, and each of their bottom elements form an "S" shaped curve. Each side element of blades on the other shaft forms a curve that is also generally concave toward the shaft, and each of their bottom elements form an inverted "S" shaped curve. The curve formed by the side element of the blades mounted to the first shaft is the inverse of the curve formed by the side element of the blades mounted to the second shaft.

DETAILED DESCRIPTION OF THE PREFERRED EMBODIMENT

Figure 1:
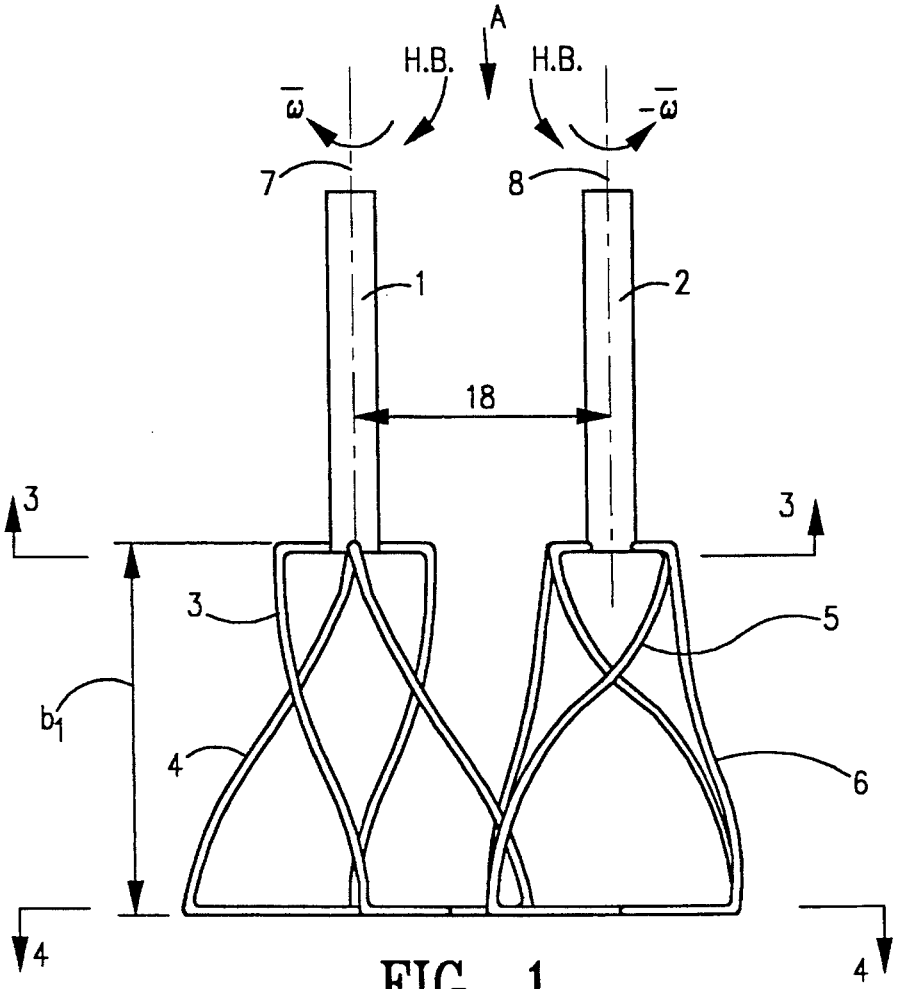
FIG. 1 is a front elevational view of a mixing blade assembly according to a preferred embodiment of the present invention.
Figure 2:
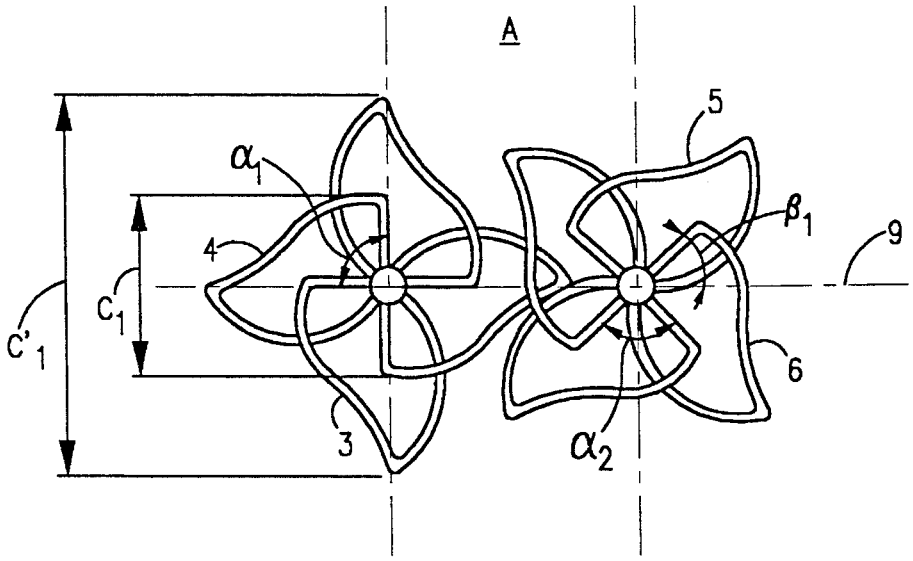
FIG. 2 is a top plan view of the mixing blade assembly of FIG. 1.

According to the first preferred embodiment of the invention the mixing blade assembly, FIG. 1, is composed of two parallel shafts 1,2 with blades 3,4,5,6 made of wire. Mounted on the shaft 1 is the pair of blades 3, 4, and the shaft 2 carries the pair 5, 6. Said shafts 1 and 2 have theoretical axes 7 and 8, respectively, with distance between them being represented by reference mark 18.

The blades 3 and 4 make an angle $\alpha_1$ to each other, and blades 5 and 6 form an angle $\alpha_2$ to each other, these angles being equal $\alpha_1=\alpha_2$. In addition, blades 5 and 6 are set at an angle $\beta_1=\frac{1}{2}\alpha_1\frac{1}{2}\alpha_2$ to the pair of blades 3 and 4. Therefore, the top element of blades 5 and 6 form an angle $\beta_1=\frac{1}{2}\alpha_2$ to a line 9 parallel to the top element of blade 3.

The height of blades 3, 4, 5, and 6 is "$b_1$", the horizontal dimension (or length) of the top elements of the blades 3, 4 is "$c_1$", and that of the bottom elements is $c_1'$; note that $\frac{1}{2}c_1'>$ one half the distance 18 and $c_1'>c_1$.

Figure 3:
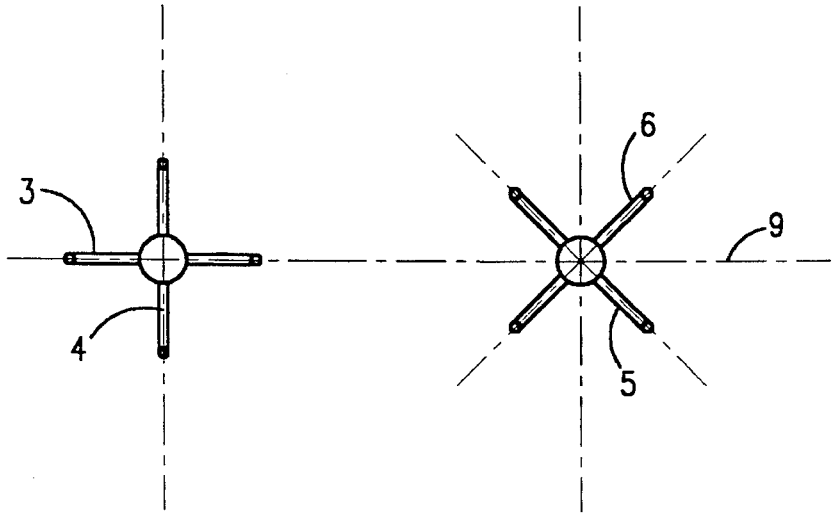
FIG. 3 is a sectional view taken along lines 3—3 of FIG. 1.
Figure 4:
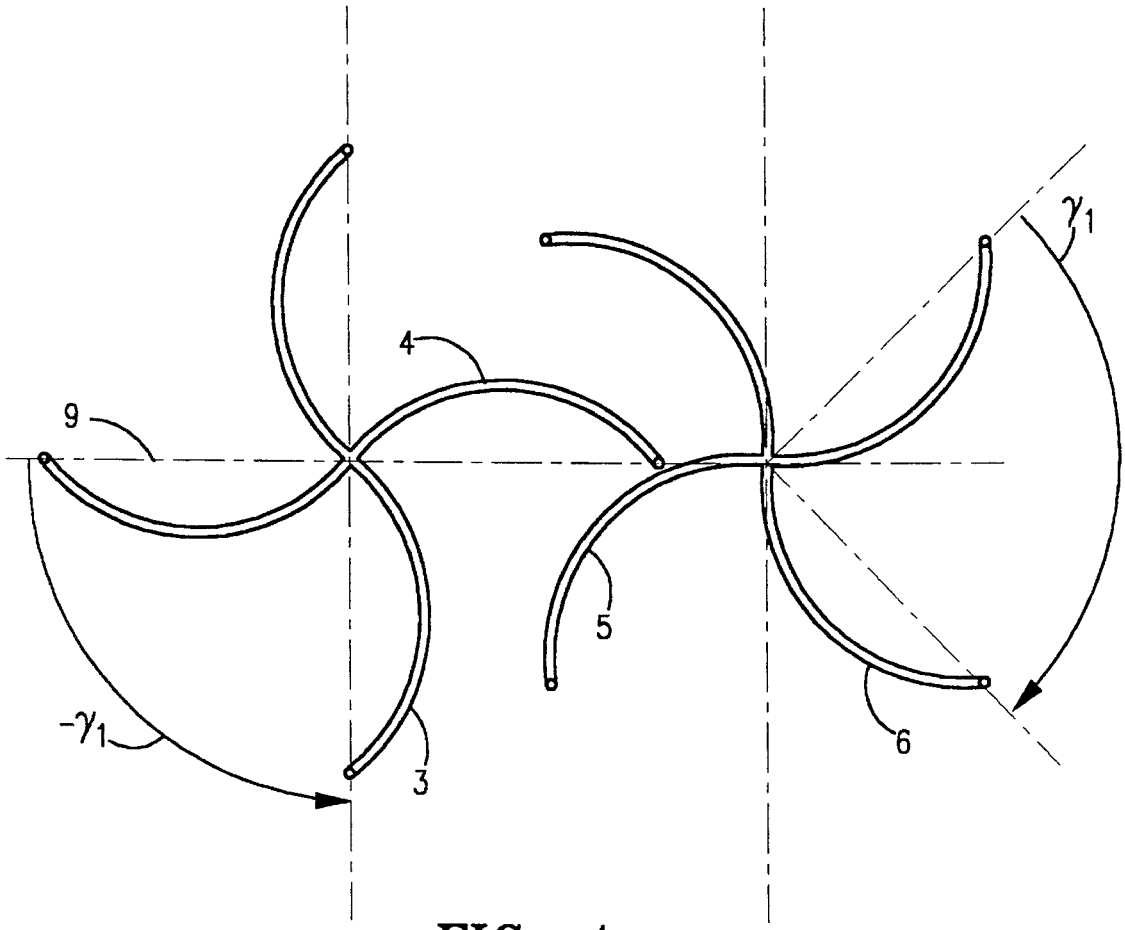
FIG. 4 is a sectional view taken along lines 4—4 of FIG. 1.
Figure 5:
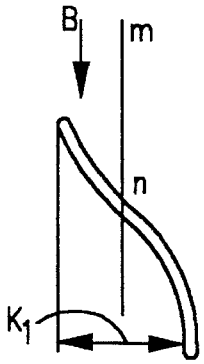
FIG. 5 is a partial side elevational view of the side element of one blade of the first shaft of the mixing blade assembly of FIG. 1.
Figure 6:
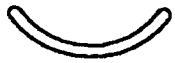
FIG. 6 is a top plan view of the side element of FIG. 5.

The upper parts of blades 3 and 4 (as viewed along the line 3—3 are rectilinear, FIG. 3. The bottom elements of blades 3 and 4 (as viewed along the line 4—4 are bent to form "S" shaped curves, whereas those of blades 5 and 6 form inverted "S" shaped curves, FIG. 4. The upper elements of blades 3 and 4 are connected with the bottom ones by side elements. Each side element forms a curve that is generally concave in one direction on one side of the inflection point "n" and generally concave in an opposite direction on the other side of the inflection point "n," FIG. 5, and bent on a curved surface with respect to the line "m" that passes through the inflection point "n," FIGS. 5 and 6. The "width" of the element, $k_1$, governs the pretwist (by an angle $-\gamma_1$ about the axis 7) of the bottom elements of blades 3 and 4.

Figure 7:
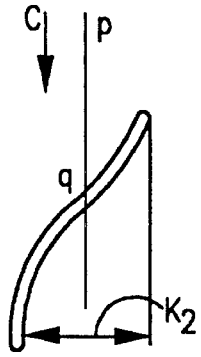
FIG. 7 is a partial side elevational view of the side element of one blade of the second shaft of the mixing blade assembly of FIG. 1.
Figure 8:
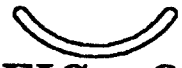
FIG. 8 is a top plan view of the side element of FIG. 7.
Figure 9:
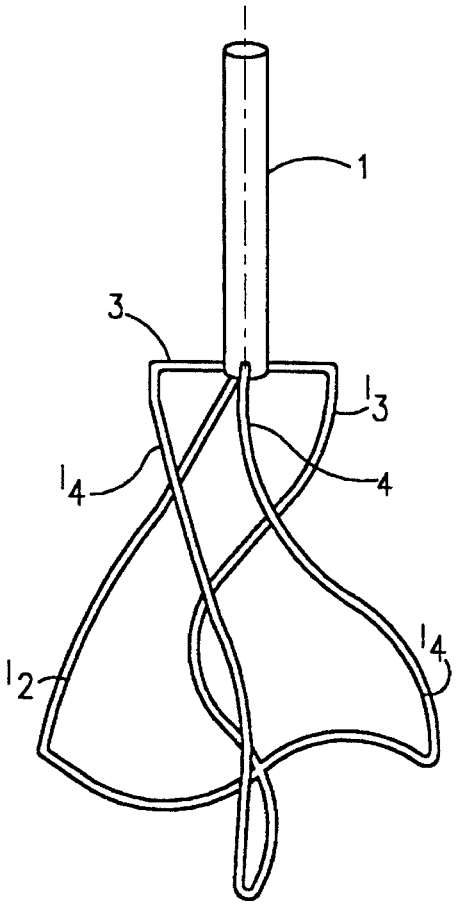
FIG. 9 is a perspective view of the first shaft of the mixing blade assembly of FIG. 1.
Figure 10:
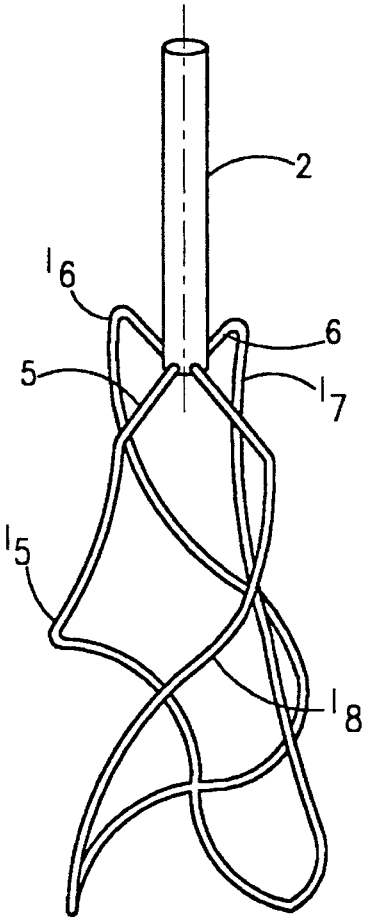
FIG. 10 is a perspective view of the second shaft of the mixing blade assembly of FIG. 1.

As well, the upper element of blades 5 and 6 are connected with the bottom ones by side elements. Each side element forms a curve that is generally concave in one direction on one side of the inflection point "q" and generally concave in an opposite direction on the other side of the inflection point "q" and bent on a curved surface with respect to the line "p" that passes through the inflection point "q," FIGS. 7 and 8. The "width" of the element, $k_2$, governs the pretwist (by an angle $\gamma_1$ about the axis 8) of the bottom parts of blades 5 and 6; it is recommended that $k_1=k_2$ for two pairs of blades. The side view of blades 3, 4, 5, and 6 are helical lines of "S" and inverted "S" types, FIGS. 9 and 10.

The angles $\gamma_1$ and $-\gamma_1$, in the first preferred embodiment are greater than thirty degrees.

Figure 14:
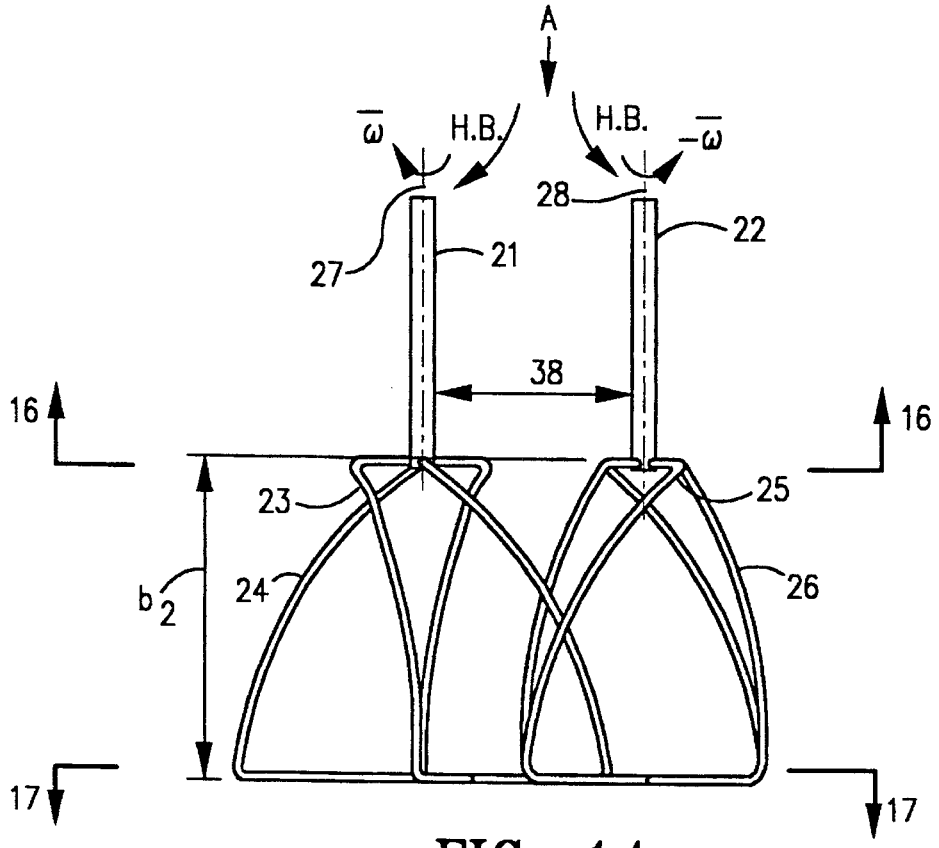
FIG. 14 is a front elevational view of a mixing blade assembly according to a second preferred embodiment of the present invention.
Figure 15:
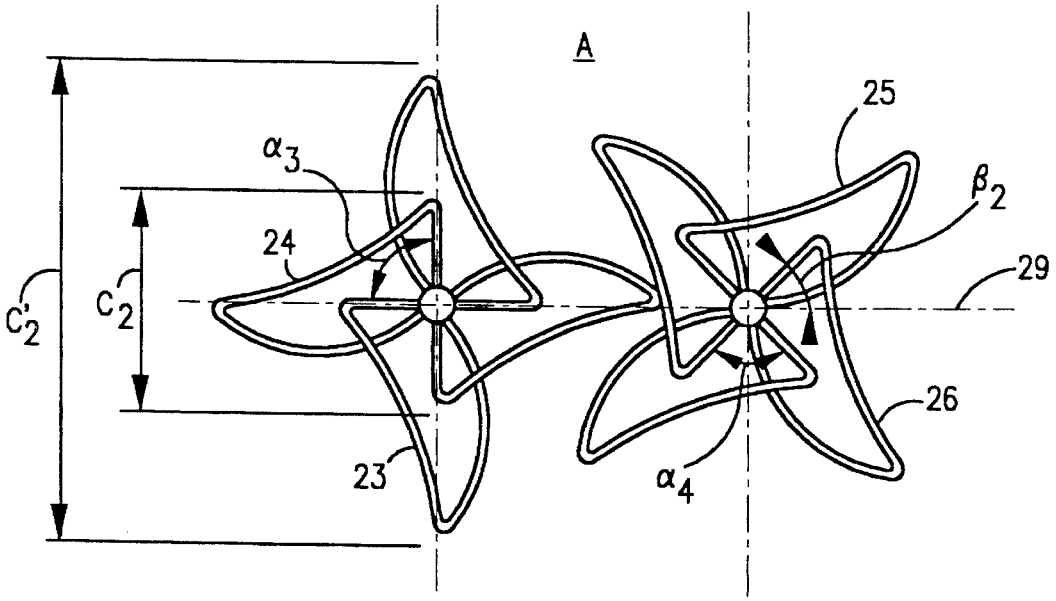
FIG. 15 is a top plan view of the mixing blade assembly of FIG. 14.

In the second preferred embodiment, the mixing blade assembly, FIG. 14, is two parallel shafts with blades 23, 24, 25 and 26 made out of wire. The shaft 21 carries a pair of blades 23, 24, and the shaft 22 carries the pair 25, 26. Shafts 21 and 22 have theoretical axes 27 and 28, respectively, with distance between them being represented by reference mark 38.

The blades 23 and 24 make an angle $\alpha_3$ to each other, and blades 25 and 26 form an angle $\alpha_4$ to each other, these angles being equal ($\alpha_3=\alpha_4$). In addition, blades 25 and 26 are set at an angle $\beta_2=\frac{1}{2}\alpha_3=\frac{1}{2}\alpha_4$ to the pair of blades 23 and 24. Therefore, the top element of blades 25 and 26 form an angle $\beta_2=\frac{1}{2}\alpha_4$ to a line 29 parallel to the top element of blade 23.

The height of blades 23, 24, 25, and 26 is "$b_2$", the length of top elements of the blades 23, 24 is "$c_2$", and that of the bottom elements is $c_2'$; note that $\frac{1}{2}c_2'>$ one half the distance 38 and $c_2'>c_2$.

Figure 16:
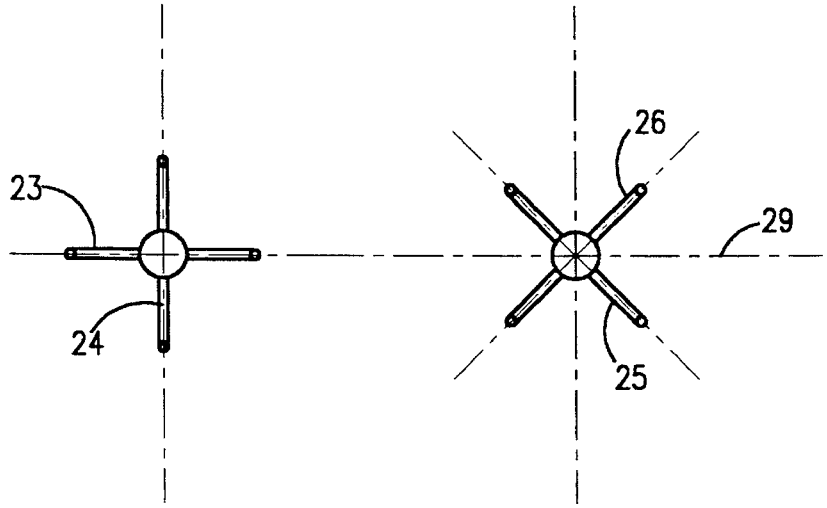
FIG. 16 is a sectional view taken along lines 16—16 of FIG. 14.
Figure 17:
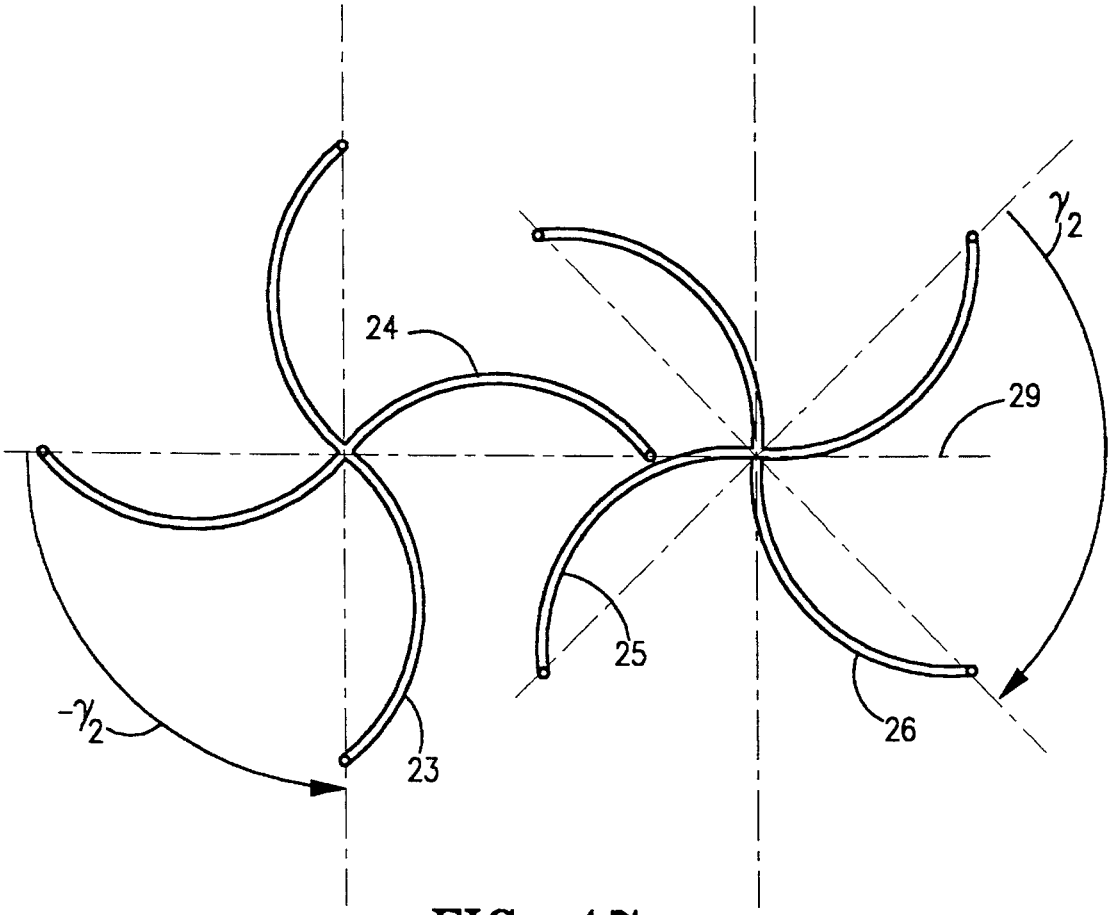
FIG. 17 is a sectional view taken along lines 17—17 of FIG. 14.
Figure 18:
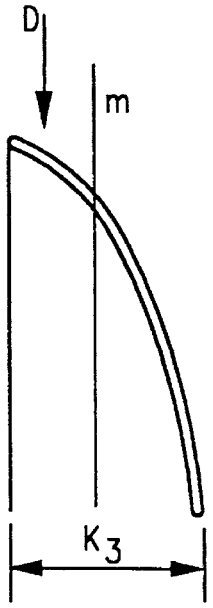
FIG. 18 is a partial side elevational view of the side element of one blade of the first shaft of the mixing blade assembly of FIG. 14.
Figure 19:
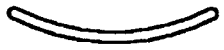
FIG. 19 is a top plan view of the side element of FIG. 18.

The upper parts of blades 23 and 24 (as viewed along the line 16—16) are rectilinear, FIG. 16. The bottom elements of blades 23 and 24 (as viewed along the line 17—17 are bent to form "S" shaped curves, whereas those of blades 25 and 26 form inverted "S" shaped curves, FIGS. 16 and 17. The upper elements of blades 23 and 24 are connected with the bottom elements by side elements. Each side element forms a curve that is generally concave away from the shaft and bent on a curved surface with respect to the line "m" that passes through the mid-point of the side element, FIGS. 18 and 19, at a distance of $k_3/2$ from its ends. The "width" of the element, $k_3$, governs the pretwist (by an angle $-\gamma_2$ about the axis 27) of the bottom parts of blade 23 and 24.

Figure 20:
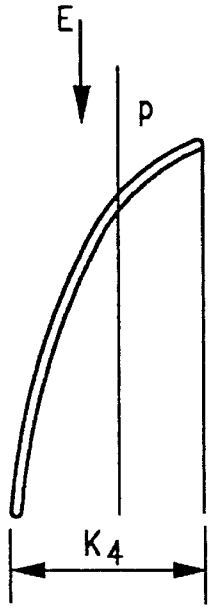
FIG. 20 is a partial side elevational view of the side element of one blade of the second shaft of the mixing blade assembly of FIG. 14.
Figure 21:
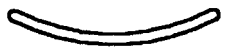
FIG. 21 is a top plan view of the side element of FIG. 20.
Figure 22:
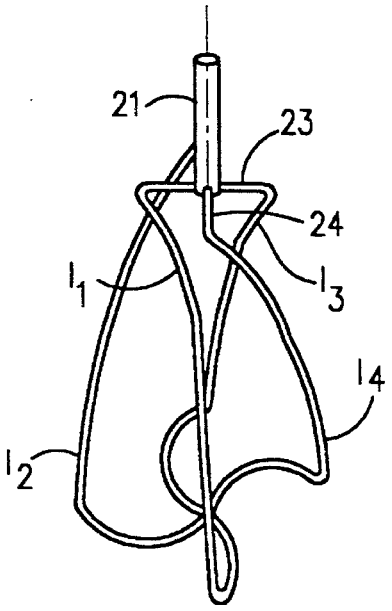
FIG. 22 is a perspective view of the first shaft of the mixing blade assembly of FIG. 14.
Figure 23:
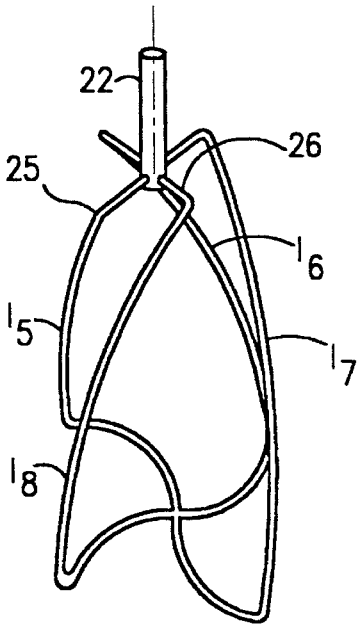
FIG. 23 is a perspective view of the first shaft of the mixing blade assembly of FIG. 14.

As well, the upper elements of blades 25 and 26 are connected with the bottom ones by side elements. Each side element forms a curve that is generally concave away from the shaft on a curved surface with respect to line "p" that is drawn through the mid-point of the side element, FIGS. 20 and 21, at a distance of $k_4/2$ from its ends. The "width" of the element, $k_4$, governs the pretwist (by an angle $\gamma_2$ about the axis 28) of the bottom parts of blades 25 and 26; it is recommended that $k_3=k_4$ for two pairs of blades. With this, the side view of blades 23, 24, 25, and 26 are helical lines of "S" and inverted "S" types, FIGS. 22 and 23.

Figure 27:
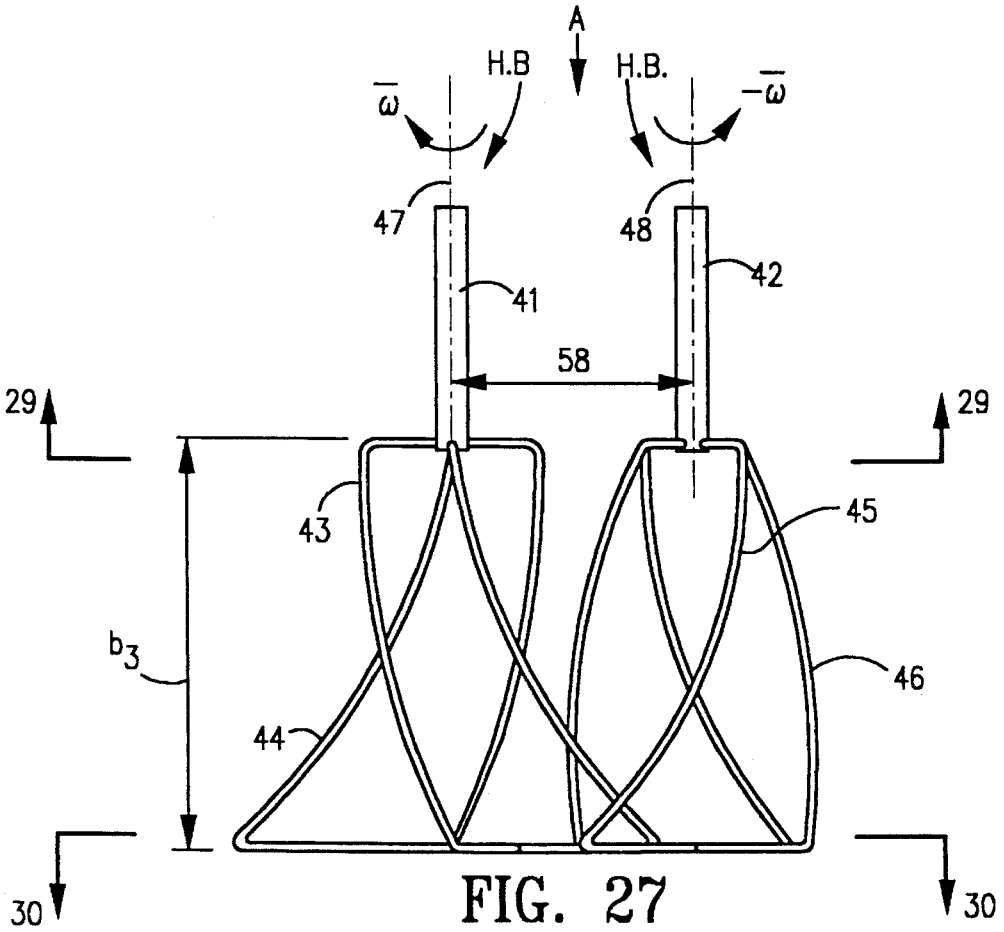
FIG. 27 is a front elevational view of a mixing blade assembly according to a third preferred embodiment of the present invention.
Figure 28:
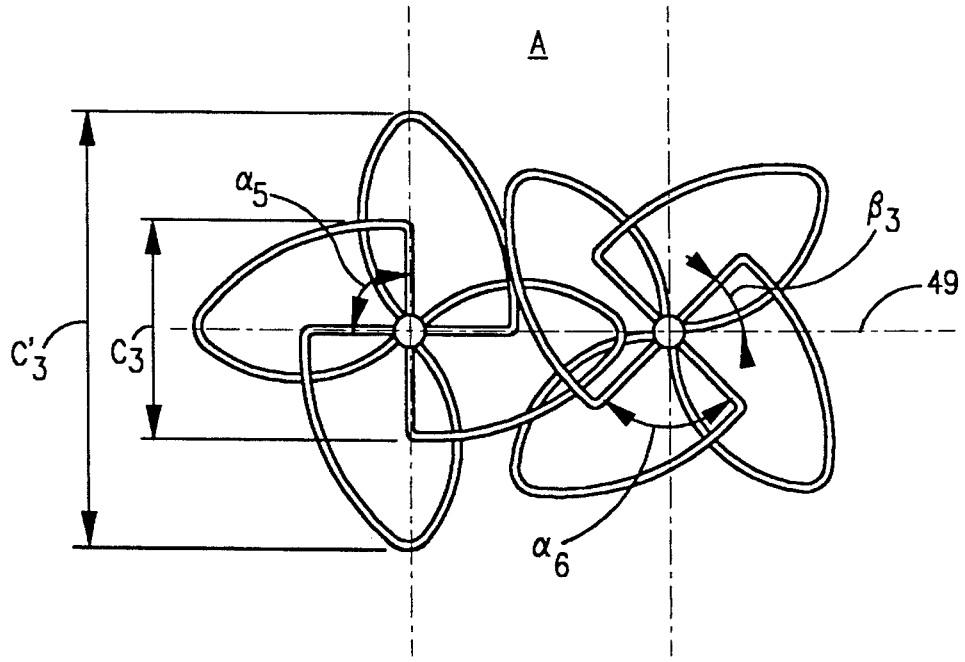
FIG. 28 is a top plan view of the mixing blade assembly of FIG. 27.
Figure 29:
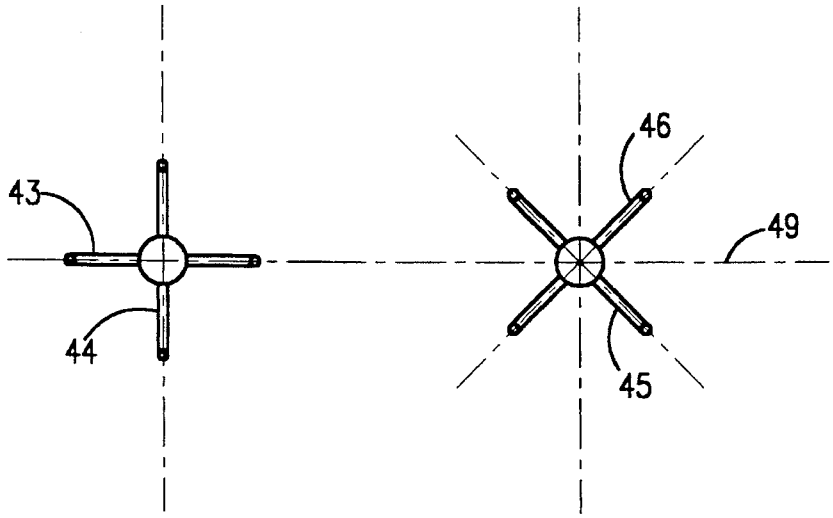
FIG. 29 is a sectional view taken along lines 29—29 of FIG. 27.

In the third preferred embodiment, the mixing blade assembly, FIG. 27, includes two parallel shafts with blades 43, 44, 45 and 46 made from wire, the shaft 41 carries a pair of blades 43, 44, and the shaft 42 carries the pair 45, 46. Shafts 41 and 42 have longitudinal axes 47 and 48, respectively; a distance between them is represented by reference mark 58. The blades 43 and 44 are turned by an angle $\alpha_5$ to each other, and blades 45 and 46, by an angle $\alpha_6$ to each other, these angles being equal ($\alpha_5=\alpha_6$). In addition, blades 45 and 46 are set at an angle $\beta_3=\frac{1}{2}\alpha_5=\frac{1}{2}\alpha_6$ to the pair of blades 43–44. Therefore, the top element of blades 45 and 46 form an angle $\beta_3=\frac{1}{2}\alpha_6$ to a line 49 parallel to the top element of blade 43.

The height of blades 43, 44, 45, and 46 is "$b_3$" the length of top elements is "$c_3$", and that of the bottom one is $c_3'$; note that $c_3'>$ than the distance 58 and $c_3'>c_3$.

Figure 30:
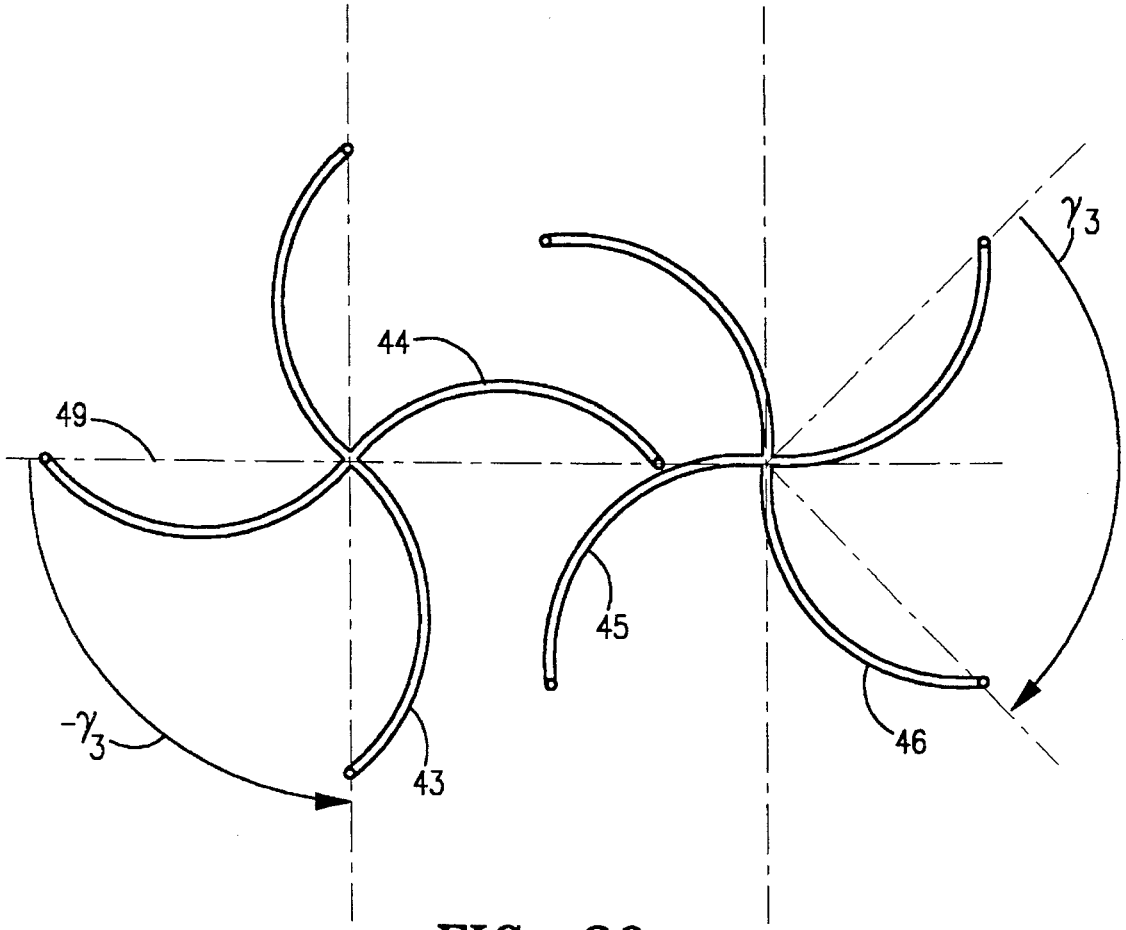
FIG. 30 is a sectional view taken along lines 30—30 of FIG. 27.
Figure 31:
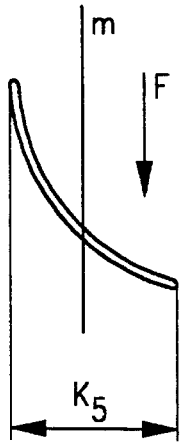
FIG. 31 is a partial side elevational view of the side element of one blade of the first shaft of the mixing blade assembly of FIG. 27.
Figure 33:
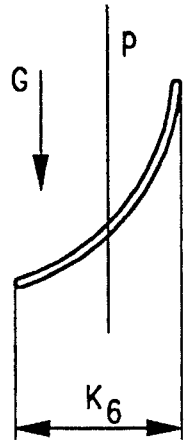
FIG. 33 is a partial side elevational view of the side element of one blade of the second shaft of the mixing blade assembly of FIG. 27.
Figure 32:
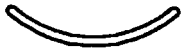
FIG. 32 is a top plan view of the side element of FIG. 31.
Figure 34:
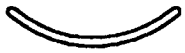
FIG. 34 is a top plan view of the side element of FIG. 33.
Figure 35:
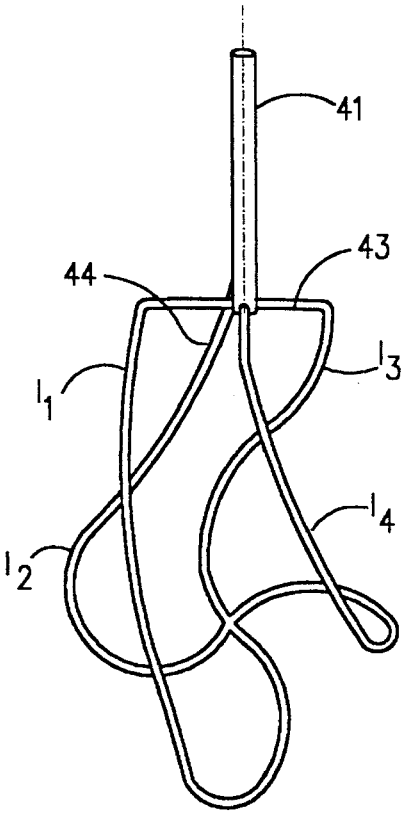
FIG. 35 is a perspective view of the first shaft of the mixing blade assembly of FIG. 27.
Figure 36:
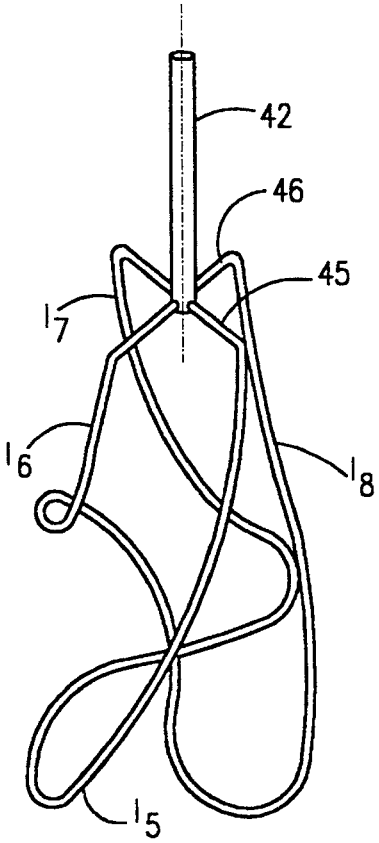
FIG. 36 is a perspective view of the first shaft of the mixing blade assembly of FIG. 27.

The upper parts of blades 43 and 44 (as viewed along the line 29—29) are segments of straight line. The bottom parts of blades 43 and 44 (as viewed along the line 30—30) are bent to form "s" shaped curves, whereas those of blades 45 and 46 are bent to form inverted "S" shaped curves, FIG. 30. The upper elements of blades 43 and 44 are connected with the bottom elements by side elements. Each of the latter forms a curve that is generally concave toward the shaft on a curved surface with respect to the line "m" that passes through the mid-point of the side element, FIGS. 31 and 32, at a distance of $k_5/2$ from its ends. The "width" of the element, $k_5$, governs the pretwist (by an angle $-\gamma_3$ about the axis 47) of bottom parts of blades 43 and 44. Also, the upper elements of blades 45 and 46 are connected with the bottom ones by side elements. Each side element forms a curve that is generally concave toward the shaft on a curved surface with respect to the line "p" that is drawn through the mid-point of the side element, FIGS. 33 and 34, at a distance of $k_6/2$ from its ends. The "width" of the element, $k_6$ governs the pretwist (by a angle $\gamma_3$ about the axis 48) of bottom parts of blades 45 and 46; it is recommended that $k_5=k_6$ for two pairs of blades. With this, the side view of blades 43, 44, 45, and 46 are three-dimensional helical lines of "S" type and inverted "S" type, FIGS. 35 and 36.

The operation of the tool of the first preferred embodiment may be described as follows.

Figure 11:
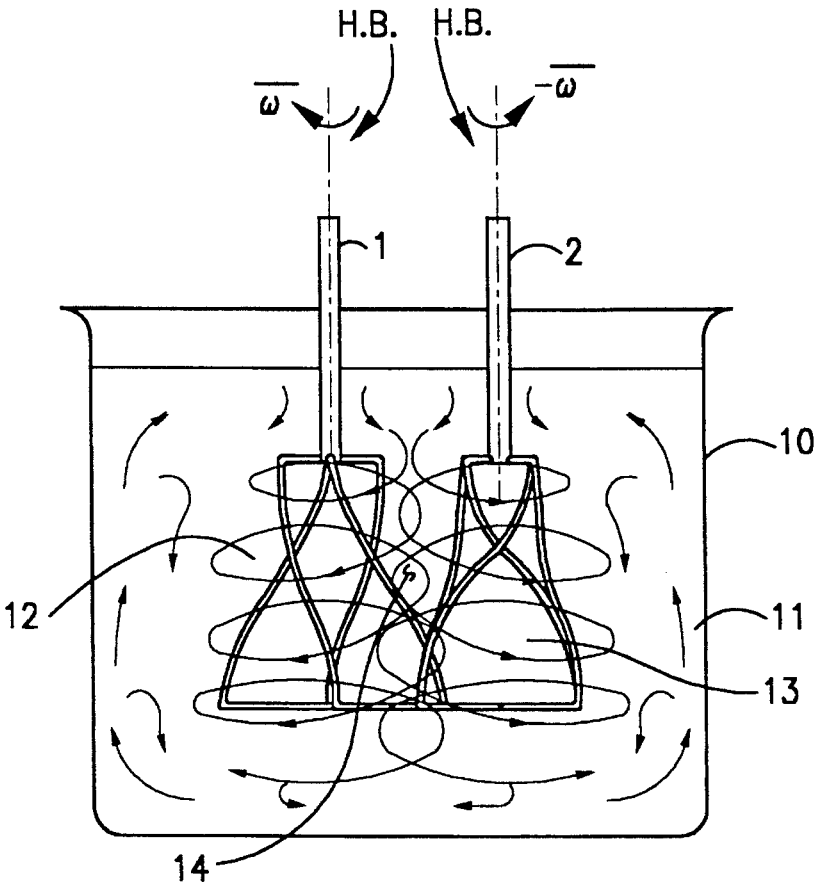
FIG. 11 depicts the flows generated by the operation of the mixing blade assembly of FIG. 1.
Figure 12:
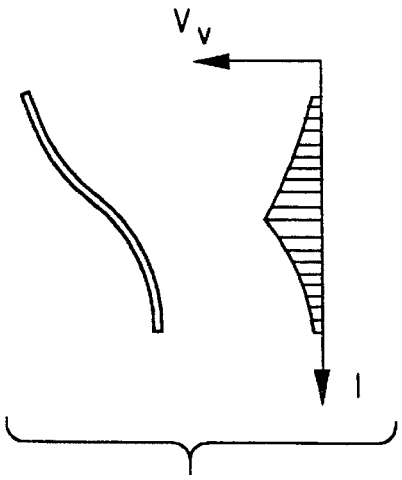
FIG. 12 gives a profile of the vertical component of velocity on the vertical extent of frames 3, 4, 5, and 6.
Figure 13:
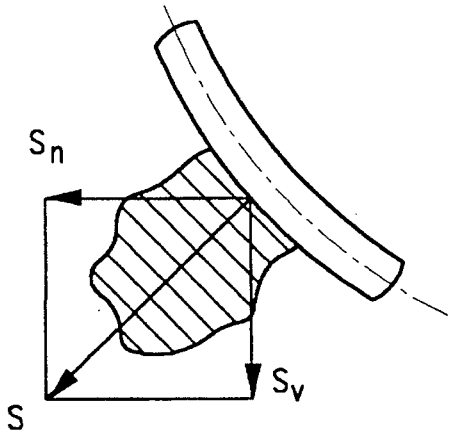
FIG. 13 depicts the interaction of a blade side element and a particle of the medium subjected to mixing.

The mixing blade assembly is placed in a tank 10 containing ingredients 11 to be mixed. The blades are counter-rotated synchronously (at angular speeds $\omega_1$ and $-\omega_1$), as shown by symbols HB, FIG. 11. Early on in the process the blades form two low-size counter-rotating zones of mixing 12 and 13, which thereafter provoke the viscous medium to move throughout the tank 10. Due to centrifugal forces the ingredients move from shafts to peripheral regions around blades 3, 4, 5, and 6. The protruding parts of the bottom elements of the blades are oriented against rotation, retard the particles in the lower domain and form the low-size countercurrent flows; this adds to mixing. The side structures $1_1$, $1_2$, $1_3$, $1_4$, $1_5$, $1_6$, $1_7$, and $1_8$ of blades 3, 4, 5, and 6 are spatial helical lines and are acting on mix ingredients so that the latter are forced not only in the horizontal plane ($S_h$) but also in the vertical plane ($s_v$) along the blades—thus, in depth of the tank 10 (note that geometry of side structures influences greatly the profile of the vertical component $V_v$ of velocity of ingredients, FIG. 12; such option makes the close interaction longer, comminutes and mixes the ingredients 11, FIG. 13. In addition, velocities of blade points increases from top to bottom (due to the bottom side being wider), therefore an extra vertical flow appears, oriented up—down, so mixing intensifies. In the internal zone 14 the ingredients 11 are mixed intensely because of powerful low-size vertical flow zones that are due to rotation of blades 3, 4, 5, and 6. These spatial helical lines make the flow around them twist. Ingredients 11 are captured over the upper part of the tank 10 and rejected from the lower part.

Figure 24:
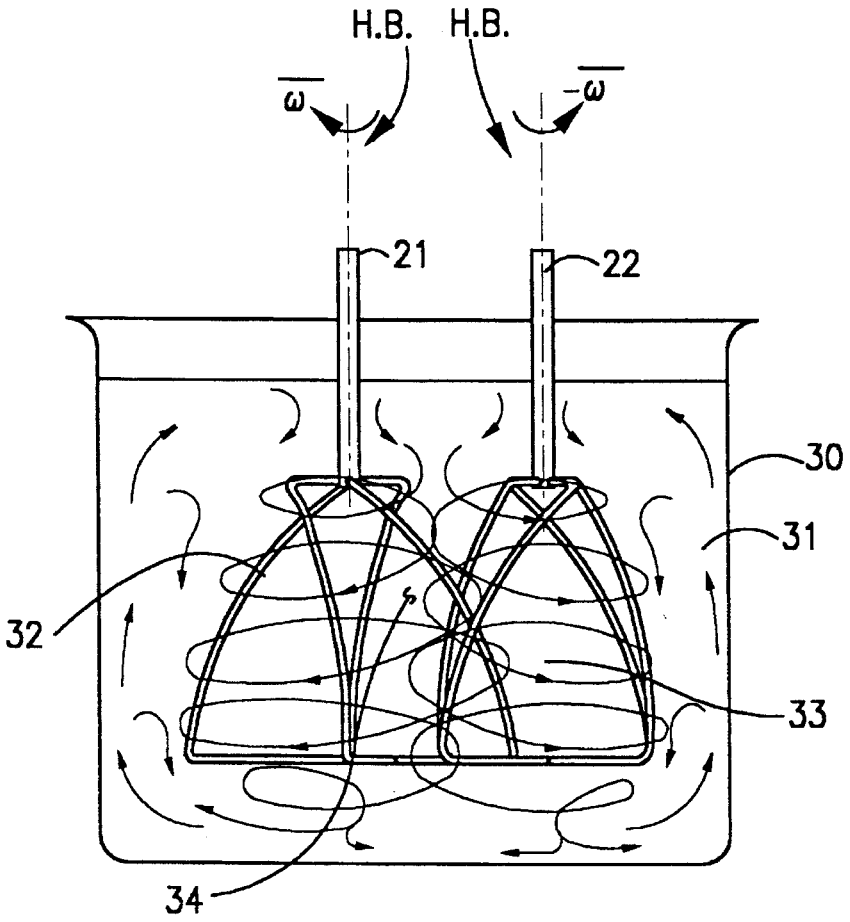
FIG. 24 depicts the flows generated by the operation of the mixing blade assembly of FIG. 14.
Figure 25:
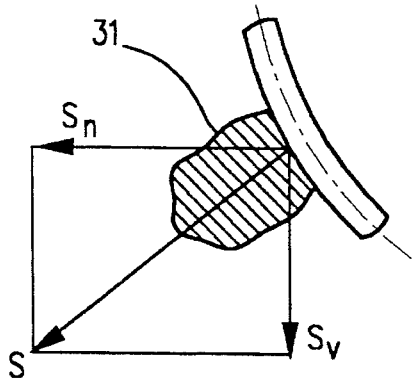
FIG. 25 depicts the interaction of a blade side element and a particle of the medium subjected to mixing.
Figure 26:
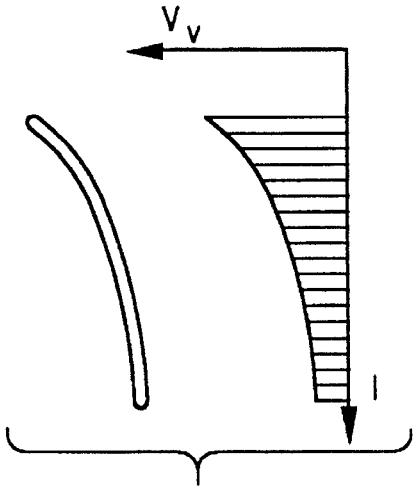
FIG. 26 gives a profile of the vertical velocity on the vertical extent of frames 23, 24, 25, and 26.

The accessory of the second preferred embodiment functions as follows. It is embedded in a tank 30, FIG. 34, with ingredients 31 subject to mixing. The blades are counter-rotated synchronously (at angular speeds $\omega$ and $-\omega$), as shown by symbols HB, FIG. 24. At the initial stage of the process the blades form two low-size counter-rotating zones of mixing 32 and 33, which thereafter involve the viscous medium throughout the contents of said tank 30. Due to centrifugal forces the ingredients move from shafts to peripheral regions around blades 23, 24, 25, and 26. The protruding parts of the bottom elements of the blades are oriented against rotation and retard particles in the lower domain, thus forming the low-size countercurrent flows; this adds to mixing. The side structures $1_1$, $1_2$, $1_3$, $1_4$, $1_5$, $1_6$, $1_7$, and $1_8$ of blades 23, 24, 25, and 26 are acting on mix ingredients so that the latter are forced not only in the horizontal plane ($S_h$) but also in the vertical plane ($S_v$) along the blades—thus, in depth of the tank 30 (note that geometry of side structures influences significantly the profile of the vertical component $V_v$ of velocity of ingredients, FIG. 26; this option makes the close interaction longer, comminutes and mixes the ingredients 31, FIG. 24. In addition, velocities of blade points increase from top to bottom (due to the bottom side being wider), therefore an extra vertical flow appears, oriented up-down, so mixing intensifies. In the shaft-to-shaft zone 34 the ingredients 31 are mixed intensely because of powerful low-size vertical flows that are due to rotation of blades 23, 24, 25, and 26. These spatial helical lines make the flow around them twist. Ingredients 31 are taken over the upper part of the tank 30 and rejected at the lower part.

Figure 37:
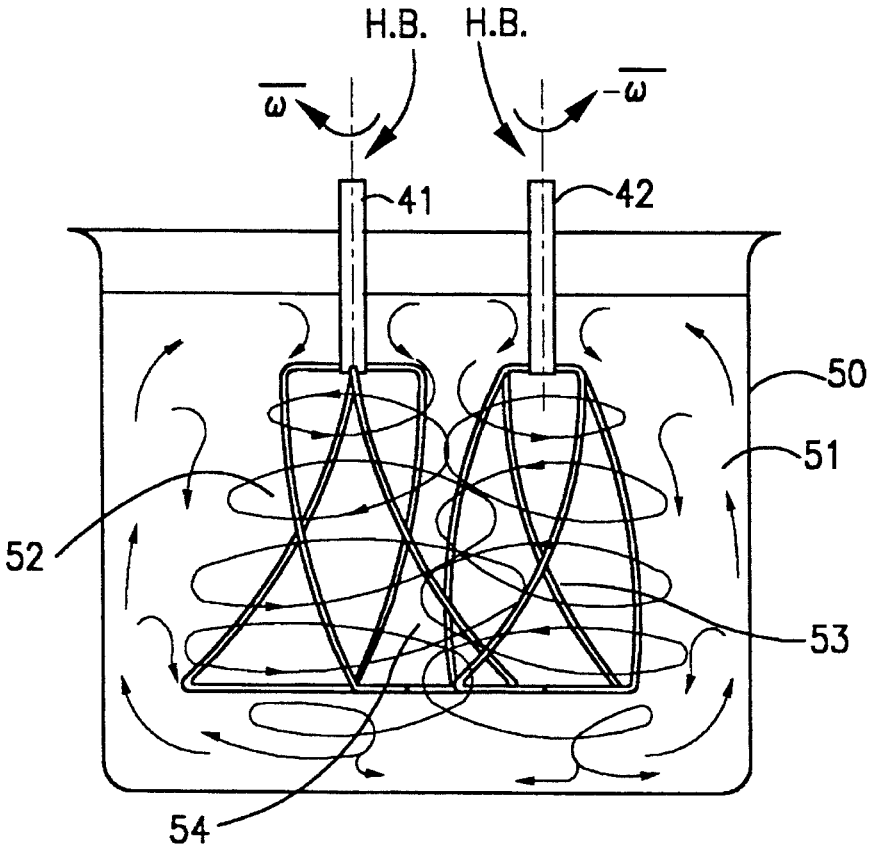
FIG. 37 depicts the flows generated by the operation of the mixing blade assembly of FIG. 27.
Figure 38:
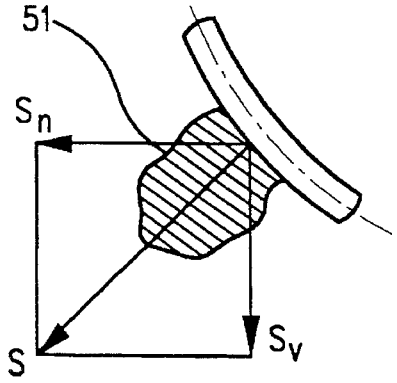
FIG. 38 depicts the interaction of a blade side element and a particle of the medium.
Figure 39:
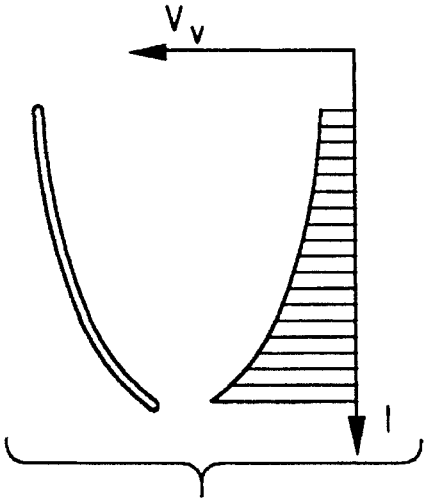
FIG. 39 gives a profile of the vertical velocity on frames 43, 44, 45 and 46.

The accessory of the third preferred embodiment operates as follows. It is embedded in a tank 50, FIG. 37, with ingredients 51 subject to mixing. The blades are counter-rotated synchronously (at angular speeds $\omega$ and $-\omega$), as shown by symbols HB, FIG. 37. At the initial stage of the process the blades form two low-size counter-rotating zones of mixing 52 and 53, which thereafter involve the viscous medium throughout the contents of said tank 50. Due to centrifugal forces the ingredients move from shafts to peripheral regions around blades 43, 44, 45, and 46. The protruding parts of the bottom elements of the blades are oriented against rotation and retard particles in the lower domain, thus forming the low-size countercurrent flows; this adds to mixing. The side structures $1_1$, $1_2$, $1_3$, $1_4$, $1_5$, $1_6$, $1_7$, and $1_8$ of blades 43, 44, 45, and 46 are acting on mix ingredients so that the latter are forced not only in the horizontal plane $S_h$, but also in the vertical plane $S_v$, along the blades—thus, in depth of the tank 50 (note that geometry of side structures affects significantly the profile of the vertical component $V_v$ of velocity of ingredients, FIG. 39; this option makes the close interaction longer, comminutes and mixes the ingredients 51, FIG. 39. Velocities of blade points increase from top to bottom (due to the bottom side being wider), therefore an extra vertical flow appears, oriented up-down, so mixing intensifies. In the shaft-to-shaft zone 54 the ingredients 51 are mixed intensely because of strong low-size vertical flows that are due to rotation of blades 43, 44, 45, and 46. These spatial helical lines cause the flow around them to twist. Ingredients 51 are taken over the upper part of the tank 50 and rejected at the lower part.

It is seen from the description above that there are opportunities to improve operation of the tool by adapting it to parameters of specific medium.

This accessory implements two concepts common in mixing engineering, both the centrifugal and propelling devices. It saves time for mixing and reduces the energy consumption, as well as enables obtaining finer dispersion of uniformly high quality.

What is claimed as new and desired to be protected by Letters Patent of the United States is:

1. A mixing blade assembly, comprising:

a first shaft having a first rotational axis;

a first shaft first blade mounted to said first shaft;

a first shaft second blade mounted to said first shaft at an angle to said first shaft first blade;

wherein said first shaft first blade includes a curved first shaft first blade bottom element connected to a first shaft first blade top element by a first shaft first blade first side element and a first shaft first blade second side element;

wherein said first shaft first blade first side element forms a particular curve and wherein said first shaft first blade second side element forms a particular curve;

wherein the particular curves formed by said first shaft first blade first and second side elements are the same;

wherein said first shaft first blade top element is shorter than said first shaft first blade bottom element;

wherein the first shaft first blade bottom element is at an angle greater than thirty degrees to the first shaft first blade top element;

wherein said first shaft first blade bottom element forms an "S" shaped curve;

wherein said first shaft second blade includes a curved first shaft second blade bottom element connected to a first shaft second blade top element by a first shaft second blade first side element and a first shaft second blade second side element;

wherein said first shaft second blade first side element forms a particular curve and wherein said first shaft second blade second side element forms a particular curve;

wherein the particular curves formed by said first shaft second blade first and second side elements are the same;

wherein said first shaft second blade top element is shorter than said first shaft second blade bottom element; and wherein said first shaft second blade bottom element is at an angle to said first shaft second blade top element.

2. The mixing blade assembly as recited in claim 1, wherein the first shaft second blade bottom element is at an angle greater than thirty degrees to the first shaft second blade top element.

3. The mixing blade assembly as recited in claim 1, wherein said first shaft second blade bottom element forms an "S" shaped curve.

4. The mixing blade assembly as recited in claim 1, further comprising:

a second shaft having a second rotational axis;

a second shaft first blade mounted to said second shaft;

a second shaft second blade mounted to said second shaft at an angle to said second shaft first blade;

wherein said second shaft second rotational axis is parallel to the rotational axis of said first shaft;

wherein said second shaft first blade includes a curved second shaft first blade bottom element connected to a second shaft first blade top element by a second shaft first blade first side element and a second shaft first blade second side element;

wherein said second shaft first blade first side element forms a particular curve and wherein said second shaft first blade second side element forms a particular curve;

wherein the particular curves formed by said second shaft first blade first and second side elements are the same;

wherein said second shaft second blade includes a curved second shaft second blade bottom element connected to a second shaft second blade top element by a second shaft second blade first side element and a second shaft second blade second side element;

wherein said second shaft second blade first side element forms a particular curve and wherein said second shaft second blade second side element forms a particular curve;

wherein the particular curves formed by said second shaft second blade first and second side elements are the same;

wherein said top elements of said blades mounted to said second shaft are shorter than said bottom elements of said blades mounted to said second shaft; and wherein said second shaft first blade bottom element is at an angle greater than thirty degrees to the second shaft first blade top element.

5. The mixing blade assembly as recited in claim 4, wherein the second shaft second blade bottom element is at an angle greater than thirty degrees to the second shaft second blade top element.

6. The mixing blade assembly as recited in claim 5, wherein said bottom elements of said blades mounted to said second shaft form inverted "S" shaped curves with respect to said bottom elements of said blades mounted to said first shaft.

7. The mixing blade assembly as recited in claim 6, wherein said side elements of said blades mounted to said second shaft are the inverse of said side elements of said blades mounted to said first shaft.

8. The mixing blade assembly as recited in claim 7, wherein said side elements of said blades mounted to said first shaft form curves that are generally concave in a first direction along a first portion of said side elements and generally concave in an opposite direction along a second portion of said side elements.

9. The mixing blade assembly as recited in claim 7;

wherein said side elements of said blades mounted to said first shaft form curves that are generally concave away from the first shaft.

10. The mixing blade assembly as recited in claim 7;

wherein said side elements of said blades mounted to said first shaft form curves that are generally concave toward the first shaft.

11. A mixing blade assembly, comprising:

a first shaft means having a rotational axis for providing rotational drive;

a first shaft first blade means mounted to said first shaft means for generating flows;

wherein said first shaft first blade means includes a curved first shaft first blade means bottom element connected to a first shaft first blade means top element by a first shaft first blade means first side element and a first shaft first blade means second side element;

wherein said first shaft first blade means first side element forms a particular curve and wherein said first shaft first blade means second side element forms a particular curve;

wherein the particular curves formed by said first shaft first blade means first and second side elements are the same;

wherein said first shaft first blade means bottom element is at an angle to said first shaft first blade means top element;

wherein said first shaft first blade means bottom element forms an "S" shaped curve;

a first shaft second blade means mounted to said first shaft means at an angle to said first shaft first blade means for generating flows;

wherein said first shaft second blade means includes a curved first shaft second blade means bottom element connected to a first shaft second blade means top element by a first shaft second blade means first side element and a first shaft second blade means second side element;

wherein said first shaft second blade means first side element forms a particular curve and wherein said first shaft second blade means second side element forms a particular curve;

wherein said particular curves formed by the first shaft second blade means first and second side elements are the same;

wherein said first shaft second blade means bottom element is at an angle to said first shaft second blade means top element;

wherein said first shaft second blade means bottom element forms an "S" shaped curve;

wherein said first shaft first and second blade means top elements are shorter than said first shaft first and second blade means bottom elements;

a second shaft means having a second rotational axis for providing rotational drive;

a second shaft first blade means mounted to said second shaft means for providing flows;

a second shaft second blade means mounted to said second shaft means at an angle to said second shaft first blade means for providing flows;

wherein said second shaft means has a rotational axis parrallel to the rotational axis of said first shaft means;

wherein said second shaft first blade means includes a curved second shaft first blade means bottom element connected to a second shaft first blade means top element by a second shaft first blade means first side element and a second shaft first blade means second side element;

wherein said second shaft first blade means first side element forms a particular curve and wherein said second shaft first blade means second side element forms a particular curve;

wherein the particular curves formed by said second shaft first blade means first and second side elements are the same;

wherein said second shaft second blade means includes a curved second shaft second blade means bottom element connected to a second shaft second blade means top element by a second shaft second blade means first side element and a second shaft second blade means second side element;

wherein said second shaft second blade means first side element forms a particular curve and wherein said second shaft second blade means second side element forms a particular curve;

wherein the particular curves formed by said second shaft second blade means first and second side elements are the same;

wherein said second shaft first and second blade means top elements are shorter than said second shaft first and second blade means bottom elements;

wherein said second shaft first blade means bottom element is at an angle greater than thirty degrees to the second shaft first blade means top element; and wherein said second shaft first and second blade means bottom elements form inverted "S" shaped curves with respect to said first shaft first and second blade means bottom elements.

12. The mixing blade assembly as recited in claim 11, wherein the second shaft second blade means bottom element is at an angle greater than thirty degrees to the second shaft second blade means top element.

13. The mixing blade assembly as recited in claim 11, wherein said second shaft first and second blade means side elements are the inverse of said first shaft first and second blade means side elements.

14. The mixing blade assembly as recited in claim 13, wherein said first shaft first and second blade means side elements form curves that are generally concave in a first direction along a first portion of said first shaft first and second blade means side elements and generally concave in an opposite direction along a second portion of said first shaft first and second blade means side elements.

15. The mixing blade assembly as recited in claim 13;

wherein said first shaft first and second blade means side elements form curves that are generally concave away from the first shaft means.

16. The mixing blade assembly as recited in claim 13;

wherein said first shaft first and second blade means side elements form curves that are generally concave toward the first shaft means.

* * * * *